United States Patent [19]

Larson

[11] 4,004,445

[45] Jan. 25, 1977

[54] ROPE BENDING DEVICE

[75] Inventor: Dean W. Larson, Portland, Oreg.

[73] Assignee: Esco Corporation, Portland, Oreg.

[22] Filed: Dec. 1, 1975

[21] Appl. No.: 636,413

[52] U.S. Cl. ..... 72/389; 29/526

[51] Int. Cl.[2] ..... B21F 1/06

[58] Field of Search ..... 140/104, 102; 72/389, 72/309, 385, 386, 457; 29/7, 526

[56] References Cited

UNITED STATES PATENTS 2,382,266 8/1945 Simonsen ..... 72/389 X

FOREIGN PATENTS OR APPLICATIONS 16,636 7/1968 Japan ..... 72/389

*Primary Examiner*—Milton S. Mehr

*Attorney, Agent, or Firm*—Tilton, Fallon, Lungmus, Chestnut & Hill

[57] ABSTRACT

A device for bending wire rope into an eye which includes opposed spaced apart L-shaped arms spaced apart for pivotal movement in a common plane and means for pulling an intermediate portion of the rope between the L-shaped arms to cause them to pivot and force the rope into an eye configuration.

5 Claims, 9 Drawing Figures

ROPE BENDING DEVICE

BACKGROUND AND DESCRIPTION OF INVENTION

This invention relates to a wire rope bending device and, more particularly, to a device adapted to form an end portion of a wire rope into an eye configuration. As such, it is an improvement on U. S. Pat. No. 3,237,658. Although the device of the aforementioned patent functioned competently, to develop eye splices, it became large, cumbersome and complex paricularly when operating on the larger sizes of wire rope. It will be appreciated that wire ropes several inches in diameter often have to be formed into eyes for logging, rigging, excavating, etc. Further, this often must be done fairly quickly, and by inexperienced labor, sometimes under less than perfect conditions. There was, therefore, a need for a rugged, simple, versatile rope beiding device—and this need has beed filled by the instant invention.

The rope bending device of the instant invention includes a frame supporting a pair of L-shaped arms for movement in a common plane, the arms forming a mouth into which a section of the wire rope is pulled and the action of the rope entering the mouth causes the arms to pivot and force the rope into the desired eye configuration.

DETAILED DESCRIPTION:

The invention is explained in conjunction with an illustrative embodiment in the accompanying drawing, in which FIG. 1 is a perspective view of the inventive device shown in the initial stage of operation against a section of wire rope;

Figure 1:
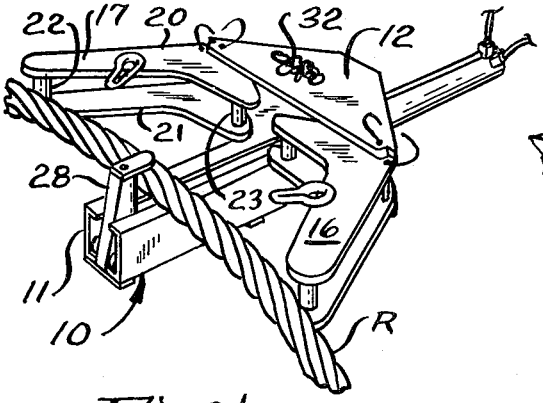

In the illustration given and with reference to FIG. 1, the numeral 10 designates generally a frame which includes an elongated base 11 and a transversely extending superstructure 12 suitably integrated, as by welding. The superstructure 12, in the illustration given, includes a pair of vertically spaced apart, parallel, aligned plates 13 and 14 (see FIG. 8). The plates 13 and 14 are rigidly interconnected by means of vertical channels 15 (still referring to FIG. 8).

Pivotally supported within the superstructure 12, i.e., between the plates 13 and 14 are a pair of L-shaped arms 16 and 17. The pivotal connection of the arm 16 is designated 18 (compare FIGS. 7 and 9) while the pivotal connection of the arm 17 to the superstructure 12 is designated 19.

Each of the L-shaped arms, in the illustration given, includes a pair of vertically spaced apart, aligned, parallel plates as at 20 and 21 (compare FIGS. 1 and 8) relative to the arm 17. The plates 20 and 21 are rigidly connected together adjacent the ends of the generally L-shape by means of rigid posts 22 and 23 (again, compare FIGS. 1 and 8 relative to the arm 17).

Figure 2:
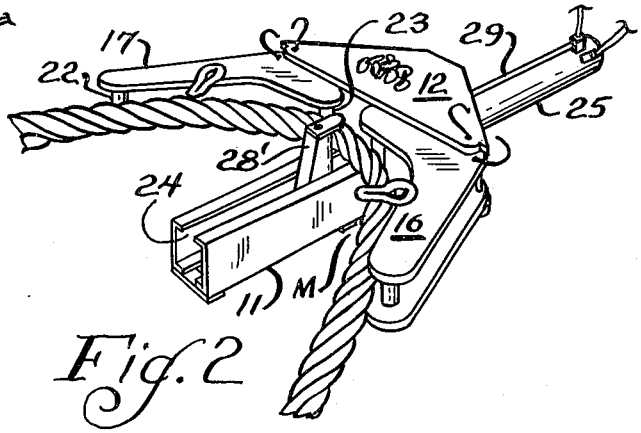
FIG. 2 is a view similar to FIG. 1 but showing the device in a later stage of operation wherein the wire rope is being formed into an eye.

The base 11 is made up of a pair of channels spaced to provide a generally hollow square tube having a longitudinally extending upwardly facing slot 24 (see FIG. 2). The base 11 adjacent one end thereof is equipped with a cylinder and piston rod unit 25 which is rigidly connected thereto. The piston rod 26 (see FIG. 9) extends within the hollow interior of the base 11 toward the front or operating end 27 — the cylinder and piston rod unit 25 being connected to the other or rear end of the base 11. At its forward end, the piston rod 26 is equipped with a hook shaped carriage 28 which is adapted to engage an intermediate portion of a wire rope R (see FIG. 1).

In the operation of the device, a length of wire rope is placed on the base 11 (see FIG. 1). The portion of the wire rope R engaged by the carriage 28 is that portion near the end but spaced therefrom which ultimately forms the apex of the eye splice. After the rope has been positioned as in FIG. 1, the cylinder and piston rod unit 25 is activated as by pressure fluid being introduced via line 29 (see FIG. 2), to retract the piston rod 25 and hence draw the carriage 28 to the 28′ position as seen in FIG. 2. There, it will be noted that the eye is beginning to be formed although at this stage there has been appreciable movement of the L-shaped arms 16 and 17. Initially, as seen in FIG. 1, the wire rope extends generally transversely of the elongated base 11 and rests lightly against the forward ends of the arms 16 and 17 while being engaged by the rearward side of the carriage 28. In the development of the eye, i.e., going from FIG. 1 to FIG. 2, the rope is bent into about a 90° configuration and now bears not only against the post 22 but also the post 23.

Figure 3:
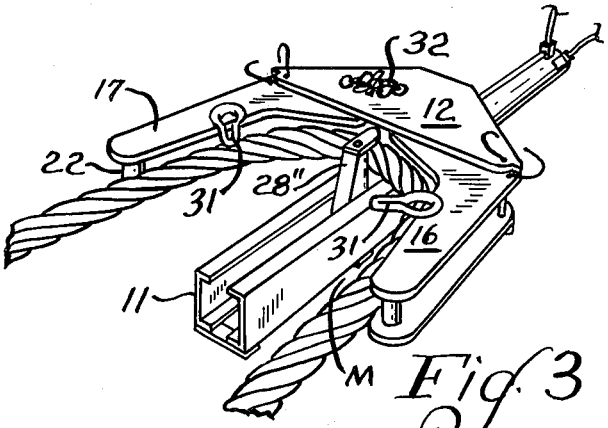
FIGS. 3 and 4 are views similar to FIGS. 1 and 2 but showing subsequent stages in the operation of the inventive device.
Figure 4:
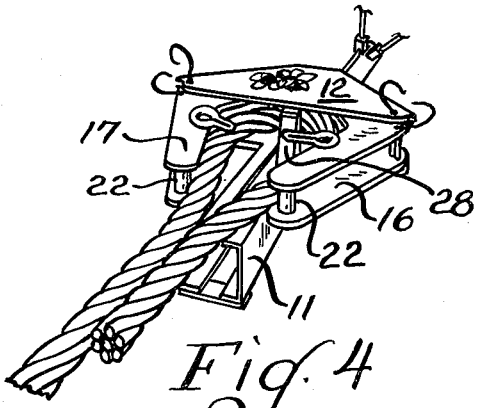

Further rearward movement of the hook-like carriage 28 — to the position designated 28″ in FIG. 3 now causes rotation or pivotal movement of the arms 16 and 17 to partially close the previously wide open mouth end (compare FIGS. 2 and 3). Further rearward movement of the carriage 28 (see FIG. 4) causes further pivotal or closing movement of the L-shaped arms 16 and 17 which, in effect, operate like jaws to bring the two parts of the wire rope together between the posts 22 of the arms 16 and 17.

Figure 5:
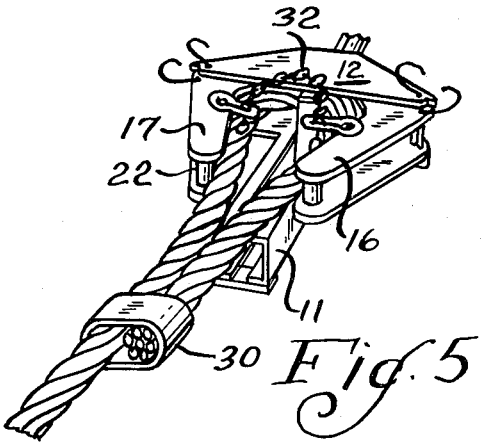
FIGS. 5 and 6 are perspective views essentially similar to FIG. 4 but differing therefrom in showing the installation of a sleeve on the now-formed eye.
Figure 6:
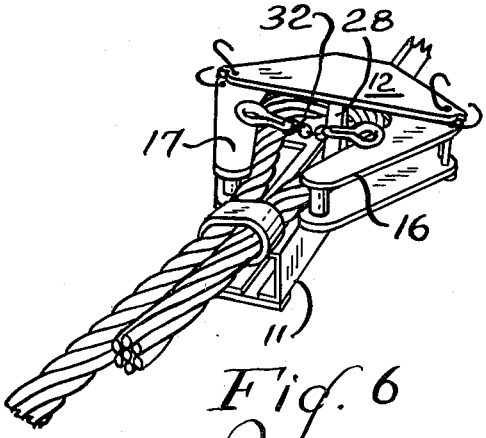

Thereafter, a sleeve 30 (see FIG. 5) is installed over the rope portion and may be moved closer to the apex of the eye as seen in FIG. 6 so as to accommodate a second sleeve (not shown) if desired.

As clearly seen in FIG. 3, each of the arms 16 and 17 is equipped with a bracket means 31 which is adapted to receive the end of a length of chain 32. This provides a safety feature should the cylinder and piston rod unit 25 fail when the rope is clamped in the fashion seen in FIGS. 4–6. If the unit 25 were to fail, the arms would open rapidly under the pressure of the deformed rope and any artisan working to install the sleeve 30 might be seriously injured. Through the very simple installation of a length of chain within the bracket means 31, an additional safeguard is provided. In FIG. 5, the chain is shown in the process of installation, while in FIG. 6 it is taut.

Further safeguards against failure of the posts 22 and 23 can be provided in the form of additional bracing, again to prevent any injury that might develop from a whipping length of wire rope. It should be appreciated that with wire ropes, particularly those of large diameter, considerable potential energy is stored when developing the eye and this is rapidly converted into kinetic energy should a part of the device fail.

Figure 7:
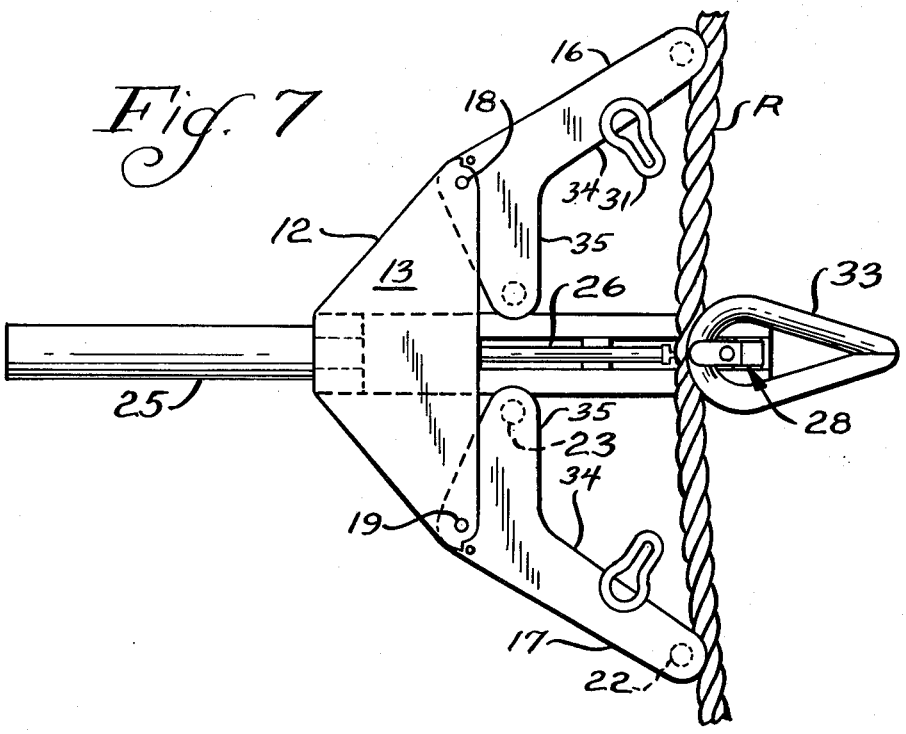
FIG. 7 is a top plan view of the device as it would be employed to form a "hard" eye, i.e., about a "thimble"
Figure 8:
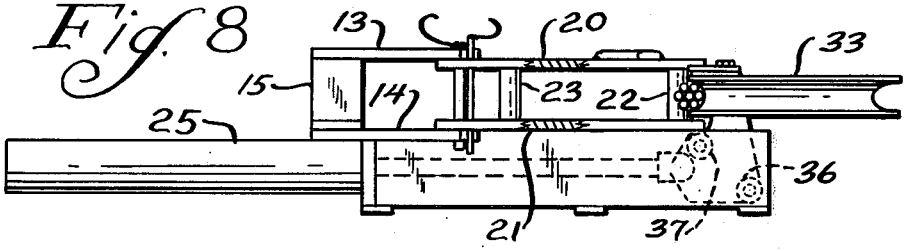
FIG. 8 is a side elevational view of the device of FIG. 7.

The inventive device makes possible the easy development of a "hard" eye, i.e., one which employs a thimble 33 (see FIGS. 7 and 8). All that is required is for the thimble 33 to be installed against the hook 28 prior to the installation of the rope R. Then, as the piston rod 26 is retracted, the rope R is folded or wrapped around the thimble 33.

As a specific example of the invention, each arm 16 and 17 has a longer portion 34 and a shorter portion 35 (see FIG. 7). The distance between the pivot point 18 and the post 22 is 20 inches (508 mm.) while the distance between the pivot point 18 and the post 23 on the shorter portion 35 is 9-½ inches (241.3 mm.). Although this is mechanically disadvantageous (having the force exerted through the shorter portion) this results in superior operation in developing eyes in large diameter ropes.

Also in the illustration given, there is a small obtuse angle between the lines connecting the posts 11 and 23 with the pivot 18 — of the order of 94°.

Figure 9:
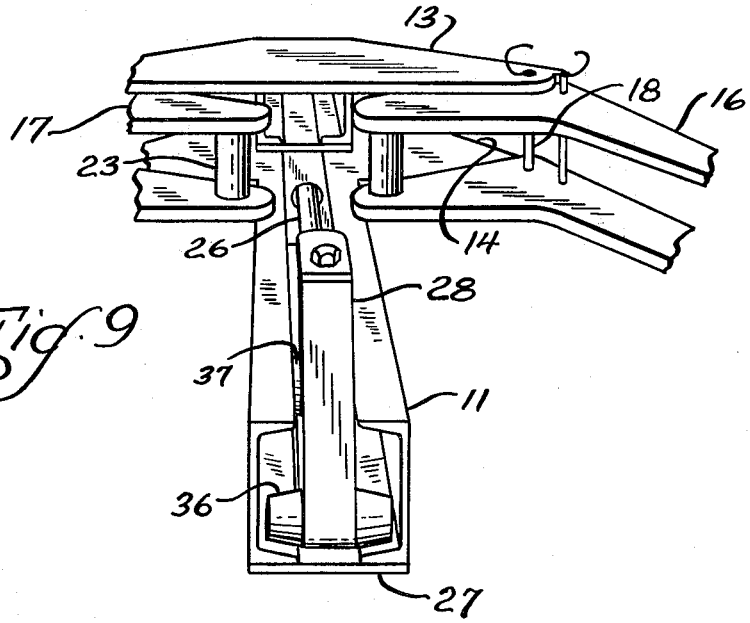
FIG. 9 is a fragmentary end elevational view of the device of FIGS. 1–6.

Further characterizing the illustrated embodiment the hook-like carriage 28 is equipped with wheels as at 36 (see FIG. 9). Four wheels are provided, two rolling against the lower flanges of the channels making up the base 11 and two against the upper flanges. The upper wheels 37 — see FIG. 8 thereby cooperate with the lower wheels 36 in stabilizing the carriage against cocking during rope deformation.

While in the foregoing specification, a detailed description of an embodiment of the invention has been set down for the purpose of illustration, many variations of the details hereingiven may be made to those skilled in the art without departing from the spirit and scope of the invention.

I claim:

1. A device for bending wire rope comprising a frame, a pair of spaced apart, generally L-shaped arms mounted on said frame for pivotal movement in a common plane, said arms being positioned on said frame in side-by-side, opposed relation to provide a rope-receiving mouth, and a hook movably mounted on said frame for confining and pulling an intermediate portion of said rope between said arms in said plane whereby engagement of said rope with said arms pivots the same to force said rope into an eye configuration, each of said arms including a pair of spaced-apart, aligned generally L-shaped plates, and a post at each end of each arm connecting aligned ends of said plates together, said posts being spaced inwardly from the edges of said plates to provide overlapping edges to confine said rope, and means for moving said hook mounted on said frame below said arms.

2. A device for bending wire rope comprising a frame, a pair of spaced apart, generally L-shaped arms mounted on said frame for pivotal movement in a common plane, said arms being positioned on said frame in side-by-side opposed relation to provide a rope-receiving mouth, and means on said frame for pulling an intermediate portion of said rope between said arms in said plane whereby engagement of said rope with said arms pivots the same to force said rope into an eye, said frame including an elongated base and a transversely extending superstructure integral with said base and positioned thereabove, said arms being pivotally mounted on said superstructure, one on each side of said base, said base being equipped with an upwardly-facing longitudinal slot, cylinder and piston rod means connected to said base adjacent one end of said base, said piston rod extending into said base and equipped with hook means extending out of said slot.

3. A device for beinding wire rope comprising a frame, a pair of spaced apart, generally L-shaped arms mounted on said frame for pivotal movement in a common plane, said arms being positioned on said frame in side-by-side, opposed relation to provide a rope-receiving mouth, and means on said frame for pulling an intermediate portion of said rope between said arms in said plane whereby engagement of said rope with said arms pivots the same to force said rope into an eye, each arm being equipped with bracket means for temporarily securing said arms in wire-clamping position.

4. A device for bending wire rope comprising a frame, a pair of spaced apart, generally L-shaped arms mounted on said frame for pivotal movement in a common plane, said arms being positioned on said frame in side-by-side opposed relation to provide a rope receiving mouth, and means on said frame for pulling an intermediate portion of said rope between said arms in said plane whereby engagement of said rope with said arms pivots the same to force said rope into an eye, said pulling means including a hook-equipped carriage, said carriage being equipped with wheels for stablilizing said carriage during rope deformation.

5. The structure of claim 1 in which said frame includes an elongated base and a transversely extending superstructure integral with said base and positioned thereabove, said arms being pivotally mounted on said superstructure, one on each side of said base, said base being equipped with an upwardly-facing longitudinal slot, said moving means being connected to said base adjacent one end of said base and at one end thereof, and said hook being connected to the other end thereof.

* * * * *